United States Patent [19]

Inoda et al.

[11] Patent Number: 4,954,053

[45] Date of Patent: Sep. 4, 1990

[54] FREE-PISTON COMPRESSOR WITH GAS SPRING CONTROL

[75] Inventors: Kenichi Inoda, Hirakata; Terumaru Harada, Ikoma, both of Japan

[73] Assignee: Matsushita Electric Industrial Co., Ltd., Osaka, Japan

[21] Appl. No.: 284,122

[22] Filed: Dec. 14, 1988

[30] Foreign Application Priority Data

Dec. 14, 1987 [JP] Japan ..... 62-315915
Aug. 30, 1988 [JP] Japan ..... 63-215432

[51] Int. Cl.[5] ..... F04B 49/08

[52] U.S. Cl. ..... 417/379; 417/214; 62/6

[58] Field of Search ..... 417/379, 340, 214; 60/520; 62/6; 92/134

[56] References Cited

U.S. PATENT DOCUMENTS 4,418,533 12/1983 Folsom ..... 60/520
4,613,285 9/1986 Sato et al. ..... 417/418

FOREIGN PATENT DOCUMENTS 0142040 7/1985 Japan ..... 60/520

OTHER PUBLICATIONS

The 4th International Conference on Stirling Engines "The Japan Society of Mechanical Engineers", Conference held Nov. 7–10, 1988.

*Primary Examiner*—Leonard E. Smith
*Assistant Examiner*—David W. Scheuermann
*Attorney, Agent, or Firm*—Wenderoth, Lind, & Ponack

[57] ABSTRACT

A free-piston compressor which has a cylinder, a compressor piston disposed movably in the cylinder, thereby first and second chambers being formed in the cylinder, a low pressure pipe coupled to the first chamber through which pipe, low pressure fluid flows, a high pressure pipe coupled to the first chamber through which, high pressure fluid flows, two valves coupled between the low pressure and high pressure pipes, and the second chamber, a control device for controlling the two valves in a manner that a dead point position of the compressor piston is kept at a target point, and driving means for driving the compressor piston.

8 Claims, 3 Drawing Sheets

FREE-PISTON COMPRESSOR WITH GAS SPRING CONTROL

BACKGROUND OF THE INVENTION

This invention relates to a free-piston compressor, and more particularly to control of top clearance thereof.

A conventional free-piston compressor is as shown in FIG. 1. The compressor uses a refrigerant compressor used for a refrigerator and a free-piston stirling engine as driving means of compressor piston, and as a whole, comprises an engine portion, seal portion and compressor portion. First, the engine portion is explained. In container 1, working fluid of a stirling engine such as helium, nitrogen etc. is encapsulated. The working fluid (e.g., helium) flows through pipe 27 and is heated by heater 2, and cooled by cooler 3. Regenerator 4 is disposed between heater 2 and cooler 3. Heater 2, cooler 3 and regenerator 4 are disposed in pipe 27. The pipe 27 is also used for communicating compression space 22 and expansion space 23. A displacer 5 is slidably movable on an inner surface of container 1 in spaces 22 and 23. Rod 30 is connected to displacer 5 and disposed into a hole having gas spring space 24. Power piston 6 is also slidably movable on the inner surface of container 1 in space 28 and bounce space 26. The space 28 communicates with space 22 through path 29. A rod 7 is connected to power piston 6.

Next, compressor portion is explained. A the compressor piston 9 to which rod 7 is connected is slidably movable on an inner surface of a cylinder 8 in compression chamber 12 and spring chamber 25. There may be a gap between piston 9 and cylinder 8. The cylinder 8 is formed integrally with container 1. A low pressure pipe 10 and high pressure pipe 14 are connected to cylinder 8 through paths 31, 32, and in compression chamber 12 and paths 31, 32 of cylinder 8 proximate pipes 10 and 14, suction valve 11 and discharge valve 13 are disposed. A condenser 15 is inserted into high pressure pipe 14, and evaporator 17 is inserted into low pressure pipe 10, and these two pipes 14 and 10 are connected through expansion valve 16. A compression spring 18 is disposed in spring chamber 25 of cylinder 8 to prevent the occurrence of collision of compressor piston 9 and cylinder 8 due to difference of pressure between the working fluid (e.g., helium) and refrigerant upon cease of operation.

Next, the seal portion is explained. 19 denotes a path which communicates to the outside atmosphere. Sealing device 20 is disposed for preventing leakage of the working fluid to the outside atmosphere, and sealing device 21 is disposed for preventing leakage of refrigerant to the outside atmosphere.

Operation of the compressor is now explained. With a predetermined timing power piston 6 and displacer 5 move upwardly and downwardly, and as a result, a part of the heat which the working fluid (e.g., helium) obtains from heater 2 is converted to work against power piston 6. Normally, the phase angle of a position of displacer 5 is advanced by 60°-90° relative to the phase angle of a position of power piston 6.

As to the compressor portion, compressor piston 9, which is connected to rod 7 driven by the free-piston stirling engine, moves at the same speed as power piston 6. With upward and downward movement of compressor piston 9, gas refrigerant of low pressure and low temperature flows in low pressure pipe 10 through suction valve 11 into compression chamber 12 and is compressed therein to be of high pressure and high temperature, and then, is discharged through discharge valve 13 into high pressure pipe 14. Further, it flows into condenser 15 to become liquid phase with high pressure and then, flows through expansion valve 16 to become both gas and liquid phases of low pressure and low temperature and then, flows into evaporator 17 so that it is heated at evaporator 17 to thereby become gas phase of low pressure and low temperature, and then, flows into low pressure pipe 10.

At the above-stated one cycle process, some of the work that compressor piston 9 carried out on the refrigerant and the heat that the refrigerant obtained at evaporator 17 is discharged at condensor 15 through the refrigerant, and the cooled heat and the heated heat are used at evaporator 17 and condensor 15.

However, the above-stated conventional compressor has drawbacks which are: (i) compressor piston 9 may collide with suction valve 11 when compressor piston 9 moves upwardly since there is no means for controlling a top dead point of compressor piston 9, and (ii) volumetric efficiency and adiabatic efficiency decrease as a result of dead space increasing when compressor piston 9 moves too much downwardly.

The stroke of compressor piston 9 can be made constant by controlling, for example, heat input to heater 2. The refrigerant flows between spring chamber 25 and compression chamber 12 through a gap formed between compressor piston 19 and cylinder 8. However, the mass of refrigerant which flows in one direction differs from that of refrigerant which goes from so that a difference in average pressure occurrs between spring chamber 25 and compression chamber 12. Thereby, compressor piston 9 moves gradually downwardly or upwardly. This phenomenon is applicable to helium as working fluid which moves between bounce space 26 of the free-piston type stirling engine and working space (total space of compression space 22, cooler 3, regenerator 4, heater 2, expansion space 23, path 27, 29 and space 28) through gap formed between power piston 6 and container 1 so that compressor piston 9 moves gradually downwardly or upwardly due to the difference in the mass flowing in opposite directions.

SUMMARY OF THE INVENTION

The present invention, therefore, has as its principal object the provision of an improved free-piston compressor which does not have the above-stated drawbacks.

Another object of the invention is to provide an improved free-piston compressor which has a path which communicates a spring chamber of the compressor with a low pressure pipe/high pressure pipe, and means for moving a fluid between the spring chamber and the low pressure pipe/high pressure pipe, so that top clearance of the compressor may be controlled to be positive and be made smaller. Thereby, energy is saved since volumetric efficiency/adiabatic efficiency are increased, and collision of the compressor piston and the suction valve/cylinder is prevented so that reliability of the compressor is improved.

While the novel features of the invention are set forth in the appended claims, the invention, both as to organization and content, will be better understood and appreciated, along with other objects and features thereof, from the following detailed description taken in conjunction with the drawings.

DETAILED DESCRIPTION OF THE INVENTION

Figure 2:
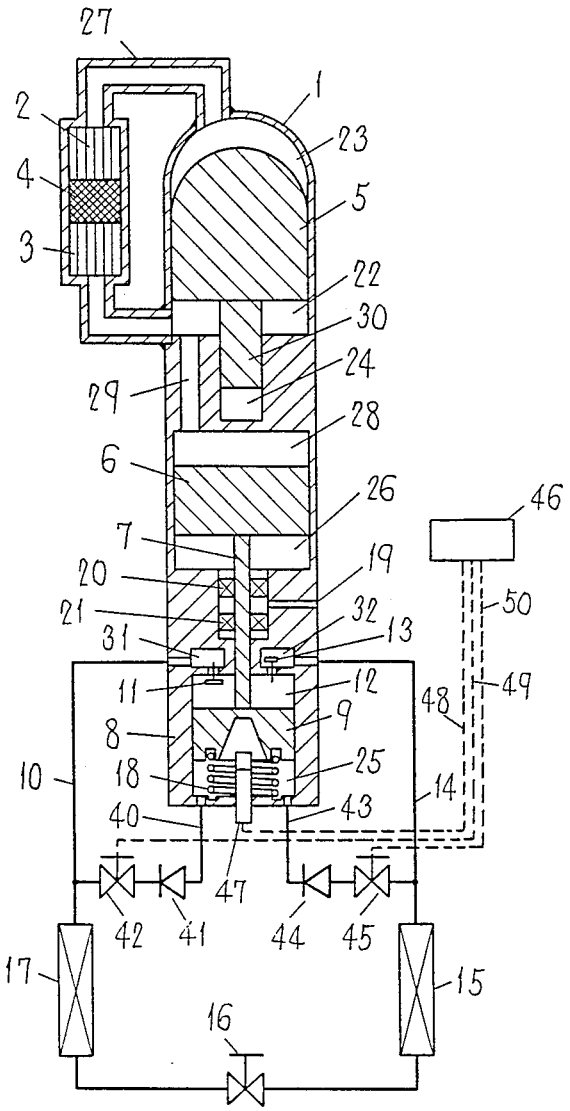
FIG. 2 is a vertical sectional view of a first embodiment of a free-piston type compressor according to the invention.
Figure 3:
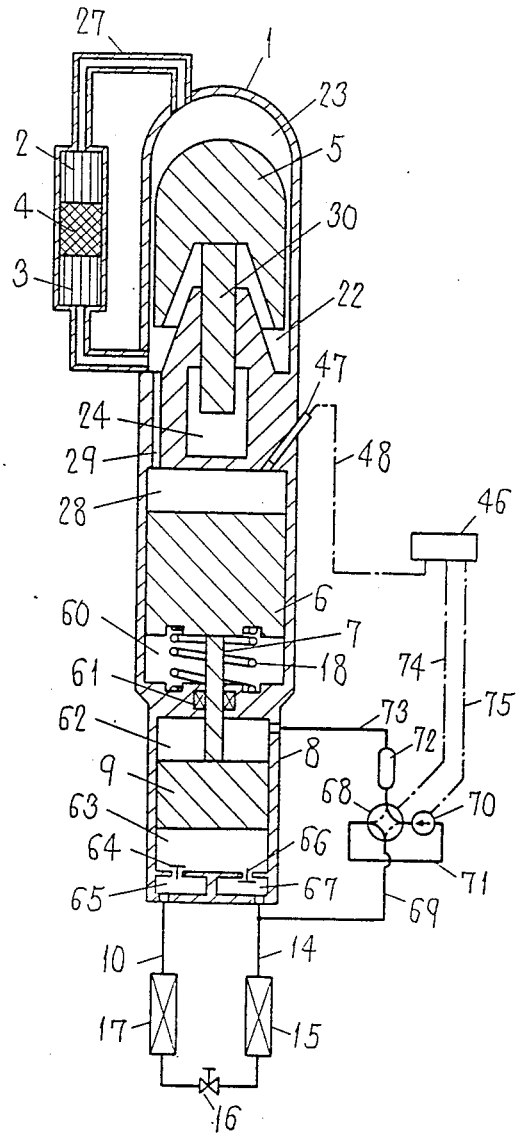
FIG. 3 is a vertical sectional view of a second embodiment of a free-piston type compressor according to the invention.

The invention is now explained with reference to FIGS. 2 and 3 showing first and second embodiments of the invention.

Figure 1:
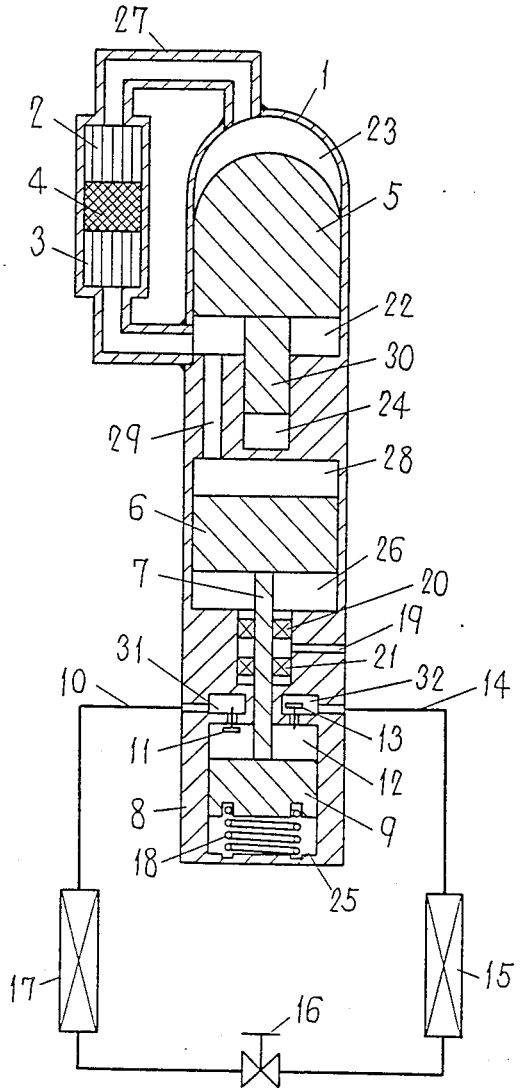
Fig. 1 PRIOR ART
FIG. 1 is a vertical sectional view of a conventional free-piston type compressor.

First, the first embodiment is explained with reference to FIG. 2. As apparent from the comparison of FIG. 1 (prior art) and FIG. 2 (first embodiment), basic structure of the first embodiment is almost the same as FIG. 1 compressor. Therefore, in FIG. 2, the same numerals as in FIG. 1 are used to show the same components as in FIG. 1 so that additional explanations are omitted. Different components or portions are now explained. As apparent from FIG. 2 spring chamber 25 is connected to low pressure pipe 10 through pipe 40, check valve 41, and flow-control valve 42, and also connected to high pressure pipe 14 through pipe 43, check valve 44 and flow control valve 45. These flow-control valves 42 and 45 are controlled by control device 46. 47 denotes a position detector of eddy current type for detecting a position of compressor piston 9. Output signal of position detector 47 is transmitted to control device 46 through signal line 48 and then, control device 46 transmits control signals to valve 42 and 45 through signal lines 49 and 50, respectively so that opening of valves 42, 45 are adjusted in accordance with position of compressor piston 9.

Check valves 41 and 44 are of the structure that their response frequency is high enough to be opened and closed to follow the operation frequency of compressor piston 9.

The operation of the FIG. 2 compressor is explained. When displacer 5 moves downwardly, volume of compression space 22 decreases and volume of expansion space 23 increases. Thereby, pressure in compression space 22 becomes higher than that in expansion space 23 and, due to difference of these pressures, low temperature helium (as a working fluid) which is in compression space 22 and cooler 3 flows to expansion space 23 through regenerator 4 and heater 2. At this time, the helium is heated by regenerator 4 and heater 2, whereas regenerator 4 itself is cooled.

By this manner, low temperature helium is heated so that pressure in the working space (total space of compression space 22, cooler 3, regenerator 4, heater 2, expansion space 23, path 27, 29, space 28) increases so that power piston 6 is pushed downwardly. At this time, power piston 6 carries out a work against rod 7. On the other hand, when displacer 5 continues to move downwardly, pressure of gas spring space 24 gradually increases and at a final stage, displacer 5 stop moving downwardly and then, starts moving upwardly. When displacer 5 moves upwardly, volume of compression space 22 increases and volume of expansion space 23 decreases. Thereby, pressure in expansion space 23 becomes higher than that in compression space 22, and, due to difference of these pressures, high temperature helium which is in expansion space 23 and heater 2 flows to compression space 22 through regenerator 4 and cooler 3. At this time, helium is cooled by regenerator 4 and cooler 3, whereas regenerator 4 itself is heated. By this manner, high temperature working fluid (e.g., helium) is cooled so that pressure of working space decreases and power piston 6 is pulled upwardly. At this time, power piston 6 carries out work against rod 7. On the other hand, when displacer 5 continues to move upwardly, pressure of gas spring space 24 gradually decreases and at a final stage, displacer 5 stops moving upwardly and then, starts moving downwardly.

In the above-stated one cycle process, a part of the heat that the helium obtained from heater 2 is converted into the work against rod 7 and another part of the heat is discharged into cooler 3. Normally, the phase angle of position of displacer 5 is advanced by 60°–90° relative to the phase angle of position of power piston 6.

As to the compressor portion, compressor piston 9 which is connected to rod 7 driven by the free-piston stirling engine moves by the same speed as power piston 6. With upward and downward movement of compressor piston 9, gas refrigerant of low pressure and low temperature which is in low pressure pipe 10 flows into compression chamber 12 through suction valve 11 and is compressed therein, thereby becoming of high pressure and high temperature, and then, is discharged to high pressure pipe 14 through discharge valve 13. Further, it flows into condenser 15 to thereby become of liquid phase with high pressure and then, flows through expansion valve 16 to thereby become of both gas and liquid phases, and then, is heated by evaporator 17 to become of gas phase with low pressure and low temperature, and then, flows into low pressure pipe 10.

In the above-stated one cycle process, some of the work that compressor piston 9 carried out against the refrigerant and heat that the refrigerant obtained from evaporator 17 is discharged at condenser 15 from the refrigerant, and cooled heat and heated heat are used at evaporator 17 and condenser 15, respectively.

The top dead point of compressor piston 9 can be controlled by adjusting average pressure of spring chamber 25. That is, in case that the top dead point position should be lifted upwardly opening of valve 45 is increased to thereby increase flow rate from high pressure pipe 14 to spring chamber 25 or opening of valve 42 is decreased to thereby decrease flow rate from spring chamber 25 to low pressure pipe 10. As a result, pressure in spring chamber 25 is increased so that the top dead point of compressor piston 9 is lifted. In contrast, in case that the top dead point of compressor piston 9 should be lowered, opening of valve 45 is decreased to thereby decrease flow rate from high pressure pipe 14 to spring chamber 25 or opening of valve 42 is increased to thereby increase flow rate from spring chamber 25 to low pressure pipe 10. As a result, pressure of spring chamber 25 is decreased so that the top dead point is lowered.

The pressure of spring chamber 25 is changed with the same frequency as upward and downward movement of compressor piston 9. Therefore, when valve 42 is completely closed and valve 45 is fully opened, minimum pressure of spring chamber 25 becomes substantially the pressure of high pressure pipe 14 so that maximum pressure becomes more than pressure of high pressure pipe 14. In contrast, when valve 45 is completely closed and valve 42 is fully opened, maximum pressure of spring chamber 25 becomes substantially the pressure of low pressure pipe 10 so that minimum pressure becomes less than pressure of low pressure pipe 10. The changeable range of average pressure in spring chamber 25 is the range between pressure of low pressure pipe 10 and that of high pressure pipe 14 in a case where there are no check valves 41 and 44. But in a case where check valves 41 and 44 exist as shown in FIG. 2, the changebable range can be expanded. In particular, in the case where there are no check valves 41 and 44, since pressure of low pressure pipe 10 is almost the same as that of high pressure pipe 14 right after operation of the compressor is started, it is impossible to change the average pressure of spring chamber 25. However, such drawback does not occur in the FIG. 2 structure.

The position detector 47 outputs a voltage signal which corresponds to a position of compressor piston 9 and transmits the signal to control device 46. When there is a difference between the voltage signal and a voltage corresponding to a target valve of top dead point position, the control device 46 functions as follows. When the top dead point position of compressor piston 9 is above a target value, opening of valve 45 is decreased and then, when a position of compressor piston 9 reaches the target position, opening of valve 45 is kept constant. If a position of compressor piston 9 does not reach the target position even when valve 45 is completely closed opening of valve 42, is increased and when the target value is reached, opening of valve 42 is kept constant. When the top dead point position of compressor piston 9 is below a target value, opening of valve 42 is decreased and then, when a position of compressor piston 9 reaches a target valve, opening of valve 42 is kept constant.

If a position of compressor piston 9 does not reach the target position even when valve 42 is completely closed, opening of valve 45 is increased and when the target value is reached, opening of valve 45 is kept constant.

Under a state of normal operation, flow rate from high pressure pipe 14 to spring chamber 25 and flow rate from spring chamber 25 to low pressure pipe 10 are much less than that flowing through expansion valve 16. Therefore, the energy loss caused by refrigerant flow through pipes 40, 43 is small compared to the energy loss necessary to drive compressor piston 9 due to improvement of control, thereby resulting in increase of volumetric/adiabatic efficiency.

As apparent from the foregoing, in the above embodiment, opening of valves 42, 45 is adjusted by control device 46 in accordance with output signal of position detector 47 which detects a position of compressor piston 9 to keep top dead point position of compressor piston 9 at a target position so that pressure of spring chamber 25 is adjusted to keep the top dead position of piston 9 at the target position. Thereby, there occurrs no cases that compressor piston 9 collides with suction valve 11 or inner upper surface of cylinder 8 due to the top dead point position of compressor piston 9 moving above the target position, and volumetric efficiency and nor that efficiency decrease due to the top dead point position not reaching the target point. Therefore, reliability and efficiency are improved.

Incidentally, in the above embodiment, the compressor is a compressor for refrigerant which is used for a refrigerator, but fluid is not limited to the refrigerant as above and may be, for example, air etc. Further, in the above embodiment, the driving means for driving a compressor piston is a free-piston stirling, engine, but a free-piston Otto engine, a linear motor etc. may also be used as the driving means.

FIG. 3 shows a second embodiment of the invention. As apparent from, the comparison of the FIG. 3 structure and the FIG. 2/FIG. 1 structures, the basic structure of the FIG. 3 compressor is almost the same as FIG. 2/FIG. 1 compressor although the shape of each component is a little bit different; for example, the shape of displacer 5 in FIG. 3 is different from the shape of displacer 5 in FIG. 2/FIG. 1. To simplify explanation, substantially same components in FIG. 3 as in FIG. 2/FIG. 1 are indicated by same numerals as in FIG. 2/FIG. 1.

As apparent from a comparison of FIG. 3 and FIG. 2, unique structure of the FIG. 3 compressor lies in a compressor portion.

Compression spring 18 is disposed between the lower surface of piston 6 and the bottom surface of bounce space 60. Position detector 47 is disposed above space 28 to detect a position of power piston 6. Seal 61 is disposed to prevent communication between space 60 and space 62. Below compressor piston 9, there is a compression chamber 63. The compression chamber 63 is connected to low pressure pipe 10 through suction valve 64 and path 65, and also connected to high pressure pipe 14 through discharge valve 66 and path 67. The path 67 is also connected to four-way valve 68 through pipe 69.

Pump 70 is connected to four-way valve 68 through pipe 71. The four-way valve 68 is connected to spring chamber 62 of cylinder 8 through container 72 and pipe 73. The four-way valve 68 and pump 70 are controlled by control device 46 through signal lines 74 and 75.

The operation of the third embodiment compressor is explained. The operation of the stirling engine portion and power piston 9 is substantially the same as in FIG. 2, and therefore, its detailed explanation is omitted. Control of dead space (i.e., top clearance) of a compressor is carried out as follows. Position detector 47 detects a position of power piston 6 and transmits a position signal to control device 46 through signal line 48. The control device 46, then, calculates a dead space based open the position signal and compares the calculation result with a target value, and transmits a control signal to pump 70 and four-way valve 68 through signal lines 75 and 74 so that discharge flow rate of pump 70 and switching of flowing direction between chamber 62 and high pressure pipe 14 are controlled. As a result, difference of average pressure of chamber 62 and chamber 63 is adjusted so that bottom dead point position of the compressor is adjusted.

For example, if the dead space is larger than the target value, discharge flow rate from chamber 62 to high pressure pipe 14 is decreased by pump 70. If the dead space is still larger than the target value even when the discharge flow rate becomes 0, four-way valve 68 is switched so that pump 70 discharges the refrigerant from high pressure pipe 14 to chamber 62 to the extent that the dead space becomes the target value. In contrast, if the dead space is less than the target value, the discharge flow rate from high pressure pipe 14 to chamber 62 is decreased by pump 70. If the dead space is still less than the target valve even when the discharge flow rate becomes 0, four-way valve 68 is switched so that pump 70 discharges the refrigerant from chamber 62 to high pressure pipe 14 to the extent that the dead space becomes the target value. As stated above, the dead space is kept at the target value by controlling the discharge flow rate of pump 70.

In the above embodiment, container 72 is disposed for suppressing sudden pressure change upon switching four-way valve 68 and sudden position change of compressor piston 9 when pressure fluctuation of pump 70 is conveyed directly to chamber 62. If upon switching four-way valve 68 etc., the pressure of chamber 62 suddenly increases and compressor piston 9 may collide with suction valve 64 and bottom surface of chamber 63, the compressor is operated in a state in which the dead space is enlarged. Under normal operation, flow rate of the refrigerant between high pressure pipe 14 and chamber 62 to control the dead space is much smaller than that flowing through expansion valve 16, and therefore, the energy consumed by pump 70 is smaller than that of the compressor. Therefore, in the embodiment, the compressor can operate so as to keep the top clearance smaller than in a conventional compressor so that volumetric efficiency is increased, and in addition, the decrease in losses due to increase of adiabatic efficiency is larger than the increase of consumption energy of pump 70 and four-way valve 68.

Incidentally, in the above embodiment, four-way valve 68 may be omitted by replacing spring 18 with a soft spring or a rigid spring and disposing pump 70, in this case, between chamber 62 and high pressure pipe 14. Further, chamber 62 may be coupled to low pressure pipe 10 instead of high pressure pipe 14.

In this case, similar advantages may be obtained.

While specific embodiments of the invention have been illustrated and described herein, it is realized that other modification and changes will occur to those skilled in the art. It is therefore to be understood that the appended claims are intended to cover all modifications and changes as fall within the true spirit and scope of the invention.

We claim:

1. A free-piston type compressor comprising:

a cylinder;

a compressor piston means, disposed movably in said cylinder, for dividing said cylinder into a spring chamber and a compression chamber and for compressing fluid contained in said compression chamber;

low-pressure fluid flow means, connected to said compression chamber, for introducing low-pressure fluid into said compression chamber;

high-pressure fluid flow means, connected to said compression chamber, for receiving high-pressure fluid from said compression chamber after its has been compressed by said compressor piston means;

a first pipe fluidically connected between said low-pressure fluid flow means and said spring chamber;

a first control valve disposed in said first pipe;

a first check valve means, disposed in said first pipe, for preventing flow through said first pipe from said low-pressure fluid flow means to said spring chamber;

a second pipe fluidically connected between said high-pressure fluid flow means and said spring chamber;

a second control valve disposed in said second pipe;

a second check valve means, disposed in said second pipe, for preventing flow through said second pipe from said spring chamber to said high-pressure fluid flow means;

detecting means for detecting the dead space between said compressor piston and an end of said cylinder; and control means for controlling said control valves and to adjust one of the top-dead position and the bottom-dead position of said compressor piston to be at a predetermined location in said cylinder.

2. A free-piston type compressor as recited in claim 1, further comprising a free-piston type Stirling engine means for driving said compressor piston.

3. A free-piston type compressor as recited in claim 1, wherein said low-pressure fluid flow means and said high-pressure fluid flow means are fluidically connected together to form a fluid circuit; and said fluid circuit includes a condenser, an evaporator and an expansion valve therein.

4. A free-piston type compressor comprising:

a cylinder;

a compressor piston means, disposed movably in said cylinder, for dividing said cylinder into a spring chamber and a compression chamber and for compressing fluid contained in said compression chamber;

low-pressure fluid flow means, connected to said compression chamber, for introducing low-pressure fluid into said compression chamber;

high-pressure fluid flow means, connected to said compression chamber, for receiving high-pressure fluid from said compression chamber after its has been compressed by said compressor piston means;

a pipe fluidically connected between said spring chamber and one of said low-pressure fluid flow means and said high pressure fluid flow means;

a pump disposed in said pipe;

valve means for selectively switching between a first position in which said one of said low-pressure fluid flow means and said high pressure fluid flow means is located downstream of said pump and said spring chamber is located upstream of said pump, and a second position in which said one of said low-pressure fluid flow means and said high-pressure fluid flow means is located upstream of said pump and said spring chamber is located downstream of said pump;

detecting means for detecting the dead space between said compressor piston and an end of said cylinder; and control means for controlling discharge of said pump and for switching said valve means between its first and second positions in accordance with a signal from said detecting means to adjust one of the top-dead position and the bottom-dead position of said compressor piston to be at a predetermined location in said cylinder.

5. A free-piston type compressor as recited in claim 4, further comprising a free-piston type Stirling engine means for driving said compressor piston.

6. A free-piston type compressor as recited in claim 4, wherein said low-pressure fluid flow means and said high-pressure fluid flow means are fluidically connected together to form a fluid circuit; and said fluid circuit includes a condenser, an evaporator and an expansion valve therein.

7. A free-piston type compressor as recited in claim 4, wherein said valve means comprises a four-way valve.

8. A free-piston type compressor as recited in claim 4, wherein said valve means comprises a four-way, two-position valve.

* * * * *